US008757762B2

(12) United States Patent
Jimenez et al.

(10) Patent No.: US 8,757,762 B2
(45) Date of Patent: Jun. 24, 2014

(54) INKJET PRINTER WITH DOT ALIGNMENT VISION SYSTEM

(75) Inventors: Luis Alejandro Jimenez, Moultonborough, NH (US); Peter Heath, Alexandria, NH (US)

(73) Assignee: Electronics for Imaging, Inc., Fremont, CA (US)

( * ) Notice: Subject to any disclaimer, the term of this patent is extended or adjusted under 35 U.S.C. 154(b) by 0 days.

(21) Appl. No.: 13/587,822

(22) Filed: Aug. 16, 2012

(65) Prior Publication Data

US 2012/0313995 A1 Dec. 13, 2012

Related U.S. Application Data

(62) Division of application No. 12/883,058, filed on Sep. 15, 2010, now Pat. No. 8,459,773.

(51) Int. Cl.
*B41J 29/393* (2006.01)

(52) U.S. Cl.
USPC ..... 347/19

(58) Field of Classification Search
None
See application file for complete search history.

(56) References Cited

U.S. PATENT DOCUMENTS

| | | | | |
|---|---|---|---|---|
| 5,600,350 | A | 2/1997 | Cobbs et al. | |
| 5,796,414 | A | 8/1998 | Sievert et al. | |
| 6,213,580 | B1 | 4/2001 | Segerstrom et al. | |
| 6,297,888 | B1 | 10/2001 | Noyes et al. | |
| 7,385,730 | B2 | 6/2008 | Ogasahara et al. | |
| 7,393,073 | B2 | 7/2008 | Zach | |
| 7,465,018 | B2 | 12/2008 | Wilcox | |
| 7,526,144 | B2 | 4/2009 | Maki et al. | |
| 7,566,182 | B2 | 7/2009 | Atkinson et al. | |
| 7,570,824 | B2 | 8/2009 | Katougi et al. | |
| 7,588,330 | B2 | 9/2009 | Tsubaki | |
| 7,596,266 | B2 | 9/2009 | Maxwell et al. | |
| 7,598,961 | B2 | 10/2009 | Higgins | |
| 7,607,752 | B2 | 10/2009 | Childers et al. | |
| 7,609,303 | B1 | 10/2009 | Lee et al. | |
| 2005/0083364 | A1 * | 4/2005 | Billow | 347/19 |
| 2006/0268061 | A1 | 11/2006 | Jeong | |
| 2008/0050112 | A1 | 2/2008 | Wernersson | |
| 2009/0079861 | A1 | 3/2009 | Liao | |
| 2009/0231374 | A1 * | 9/2009 | Van de Wynckel et al. | 347/12 |

FOREIGN PATENT DOCUMENTS

| | | | |
|---|---|---|---|
| EP | 1029698 | A2 | 8/2000 |
| EP | 1029698 | A3 | 8/2000 |

* cited by examiner

*Primary Examiner* — Geoffrey Mruk
(74) *Attorney, Agent, or Firm* — Michael A. Glenn; Perkins Coie LLP

(57) ABSTRACT

Image processing of printed patterns of arrays of dots generated by an array of inkjet heads uses a vision system, including an HD color camera that can be a fixed focus or include autofocus and zoom capabilities. Pattern recognition techniques are used to analyze as many patterns as necessary to perform multiple alignment functions, such as dot size, shape, and integrity; unidirectional, bidirectional, and step alignments; physical position and straightness of jet packs; flatness of platen or media belt; mapping imperfections in rods and rails of guiding systems; and checking jet alignments from a reference jet to all other jet packs. From such image analysis, correction values are generated that are used to effect manual or automatic adjustment of the inkjet heads physical position, voltage, temperature, and firing pulse timing and/or duration; and to position the printed dots fired from the nozzles in the inkjet heads in the appropriate position.

8 Claims, 6 Drawing Sheets

INKJET PRINTER WITH DOT ALIGNMENT VISION SYSTEM

CROSS REFERENCE TO RELATED APPLICATIONS

This application is a divisional application of U.S. patent application Ser. No. 12/883,058, filed Sep. 15, 2010, now U.S. Pat. No. 8,459,773 which application is incorporated herein in its entirety by this reference thereto.

BACKGROUND OF THE INVENTION

1. Technical Field

The invention relates to inkjet printers. More particularly, the invention relates to an inkjet printer that has a dot alignment vision system.

2. Description of the Background Art

An image to be printed in an ink jet printer is finally a map of dots with x and y coordinates for each dot. If all of the dots are in the correct position, the expected quality is achieved. The ideal dot has a circular shape and a determinate size. There are various factors that affect the ideal dot.

The drop of ink fired by an inkjet lands in the media and forms an irregular shaped dot that is close to having the shape of a circle, but that is not perfectly circular. Because the jetpack is moving when it fires, the final shape of the dot consists of a main dot and some smaller satellite dots. Changing the direction of the moving jetpack changes this pattern, such that the satellite dots are now on the other side of the main dot. Also, the speed at which the jetpack moves affects the final shape of the dot.

Most printers have the option of unidirectional or bidirectional printing. For productivity reasons, the bidirectional mode is the preferred mode. In this mode, the printer must be adjusted such that the dots printed from right to left are kept aligned to the dots printed from left to right. That is, the x coordinate of any dot should be correct no matter the printing direction. This is the bi-directional adjustment.

When an array of jetpacks, each having multiple nozzles, is printing, the media is still and the firing nozzles form lines horizontally. Then, the media advances and a new pass is made and the printed lines interlace until the complete set of the image dots are printed. When this advance distance is correct, the y coordinate of each dot is in place. This is the step adjustment.

The final shape and size of a dot also depends in the distance between the jet nozzles and the printed media and in the amount and temperature of the drop of ink fired.

When a nozzle is disabled, i.e. it does not fire ink, a blank space is left in the map of dots that form the image affecting the final quality.

Inkjet printers' quality is achieved by positioning the dots forming an image precisely. The higher the printed resolution, the smaller the dots are. Today, in the Very Grand Format segment of the printers industry, the resolutions can be over a thousand Dots Per Inch (DPI) and the tolerances can be smaller than a thousand of an inch.

Traditionally, a person performs printer adjustments by first analyzing a printed pattern with the naked eye or using an eye loop. Because these adjustments are within few thousands or even fractions of a thousand of an inch, even using a microscope, a more precise and automated method is needed to eliminate subjective quality determination. While a person typically must analyze test patterns and determine adjustment values for most very grand format printers, some printers use sensors that help to analyze printed patterns.

One problem with having a person adjust an inkjet very grand format printer, even using visual aids to analyze the adjustment patters, is the subjective quality determination and the limitation of the human eye to determine small (=<0.001") adjustment values with precision.

The sensors used today in some printers are fixed image systems that use a grid to determine if a printed pattern aligns with a mask (see Cobbs; U.S. Pat. No. 5,600,350), and that pattern is only printed in one section of the printing area, therefore not taking into account imperfections of the platen or carriage moving system. This last statement has been addressed by others and they create a table using an external measurement system to create a table and/or a special encoder strip.

It would be advantageous to provide a more precise and automated method to eliminate subjective quality determination when aligning inkjet printers.

SUMMARY OF THE INVENTION

A presently preferred embodiment of the invention provides a method and apparatus for image processing of printed patterns of arrays of dots generated by an array of inkjet heads. A vision system, including an HD color camera that can be a fixed focus or include autofocus and zoom capabilities, is provided. A software module is also provided that uses pattern recognition techniques to analyze as many patterns as necessary to perform multiple alignment functions. For example, an embodiment of the invention performs such alignment functions as dot size, shape, and integrity; unidirectional, bidirectional, and step alignments; physical position and straightness of jet packs; flatness of platen or media belt; mapping imperfections in rods and rails of guiding systems; and checking jet alignments from a reference jet to all other jet packs. From such image analysis, correction values are generated that are used to effect manual or automatic adjustment of the inkjet heads physical position, voltage, temperature, and firing pulse timing and/or duration; and to thus position the printed dots fired from the nozzles in the inkjet heads in the appropriate position.

DETAILED DESCRIPTION OF THE INVENTION

A presently preferred embodiment of the invention provides a method and apparatus for image processing of printed patterns of arrays of dots generated by an array of inkjet heads. A vision system, including an HD color camera that can be a fixed focus or include autofocus and zoom capabilities, is provided. A software module is also provided that uses pattern recognition techniques to analyze as many patterns as necessary to perform multiple alignment functions. For example, an embodiment of the invention performs such alignment functions as dot size, shape, and integrity; unidirectional, bidirectional, and step alignments; physical position and straightness of jet packs; flatness of platen or media belt; mapping imperfections in rods and rails of guiding systems; and checking jet alignments from a reference jet to all other jet packs. From such image analysis, correction values are generated that are used to effect manual or automatic adjustment of the inkjet heads physical position, voltage, temperature, and firing pulse timing and/or duration; and to position the printed dots fired from the nozzles in the inkjet heads in the appropriate position.

Another function that results from having a camera system is that different colors of ink can be analyzed using the correct wavelength of light. This is especially advantageous when printing with white ink.

Yet another advantage of embodiments of the invention is that the same vision system can be used to compensate for missing dots from disabled nozzles in one or more inkjet heads. Such compensation can be a dynamic operation.

A presently preferred embodiment of the apparatus mounts in the printer and consists of a camera and lens module and a control and processing software module that interfaces with one or more printer computer. The apparatus automatically generates adjustment values after printing and analyzing test patterns. Such values are generated using Image Quality Analysis that is based in Pattern Recognition algorithms and methods.

Thus, with the invention quality printing is consistently achieved, while printer adjustment times are minimized.

Hardware Overview

Figure 1A:
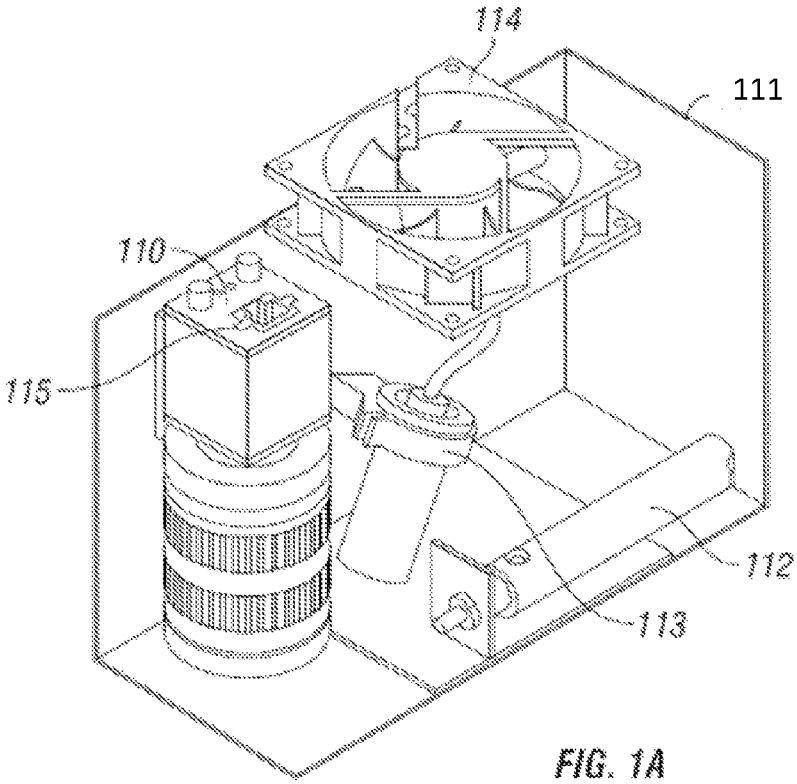
FIGS. 1*a* and 1*b* show a camera assembly for use in a dot alignment vision system for an inkjet printer according to the invention.
Figure 1B:
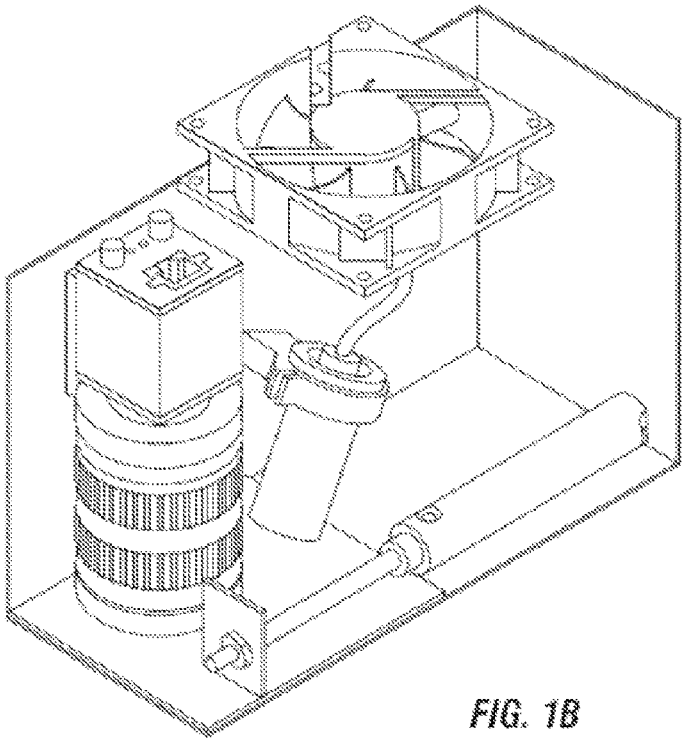

FIGS. 1*a* and 1*b* show a camera assembly for use in a dot alignment vision system for an inkjet printer according to the invention. In one embodiment, hardware is retrofitted into a printer; in another embodiment, the hardware is embedded into the printer at the time of manufacture.

Camera Assembly

The camera assembly 110 includes a camera, lens and associated electronic assembly and interface electronics. In one embodiment the camera is a Baumer EXG-50c Camera having a 5 MP GIGE CMOS sensor and a Fujinon HF12.5SA C-Face 12.5 mm Fixed Focus Lens or a Fujinon HF16SA C-Face 16 mm Fixed Focus Lens. Those skilled in the art will appreciate that other cameras, sensors, and lenses may be used in connection with the invention.

Enclosure

The enclosure 111 includes a shutter assembly 112 that protects the light source 113 and the camera lens from ink and dust when not in use. FIG. 1*a* shows the camera assembly with the shutter opened; FIG. 1*b* shows the camera assembly with the shutter closed. The shutter is operated in this embodiment by an electromechanical actuator, such as a solenoid; of the shutter may be operated by a pneumatic or other mechanism. A cooling fan 114 provides filtered ventilation and positive pressure within the enclosure.

As discussed above, the camera assembly in some embodiments may be retrofit to an existing printer. In such embodiments, the assembly includes appropriate mounting brackets. A source of compressed air is required for those embodiments that operate with a pneumatic shutter. An interconnect, such as an Ethernet RJ-45 connector 115 and cable (not shown), e.g. a continuous flex Cat-5 or better Gigabit Ethernet cable routed from a PC through an umbilical to the camera assembly, provides an electrical pathway camera related signals and information; and a separate interconnect, e.g. a multi-wire cable routed from the printer carriage digital (backplane) board to the camera assembly, is provided for power and control which, in a presently preferred embodiment of the invention comprises a power source of 24VDC @1 A, a ground (GND) connection, and a shutter signal line.

Illumination of the area to be imaged for alignment is provided in an embodiment by an internal light that may be, for example, a spot light or ring light. In various embodiments, external LED lighting may also be required.

Functional Overview

Figure 2A:
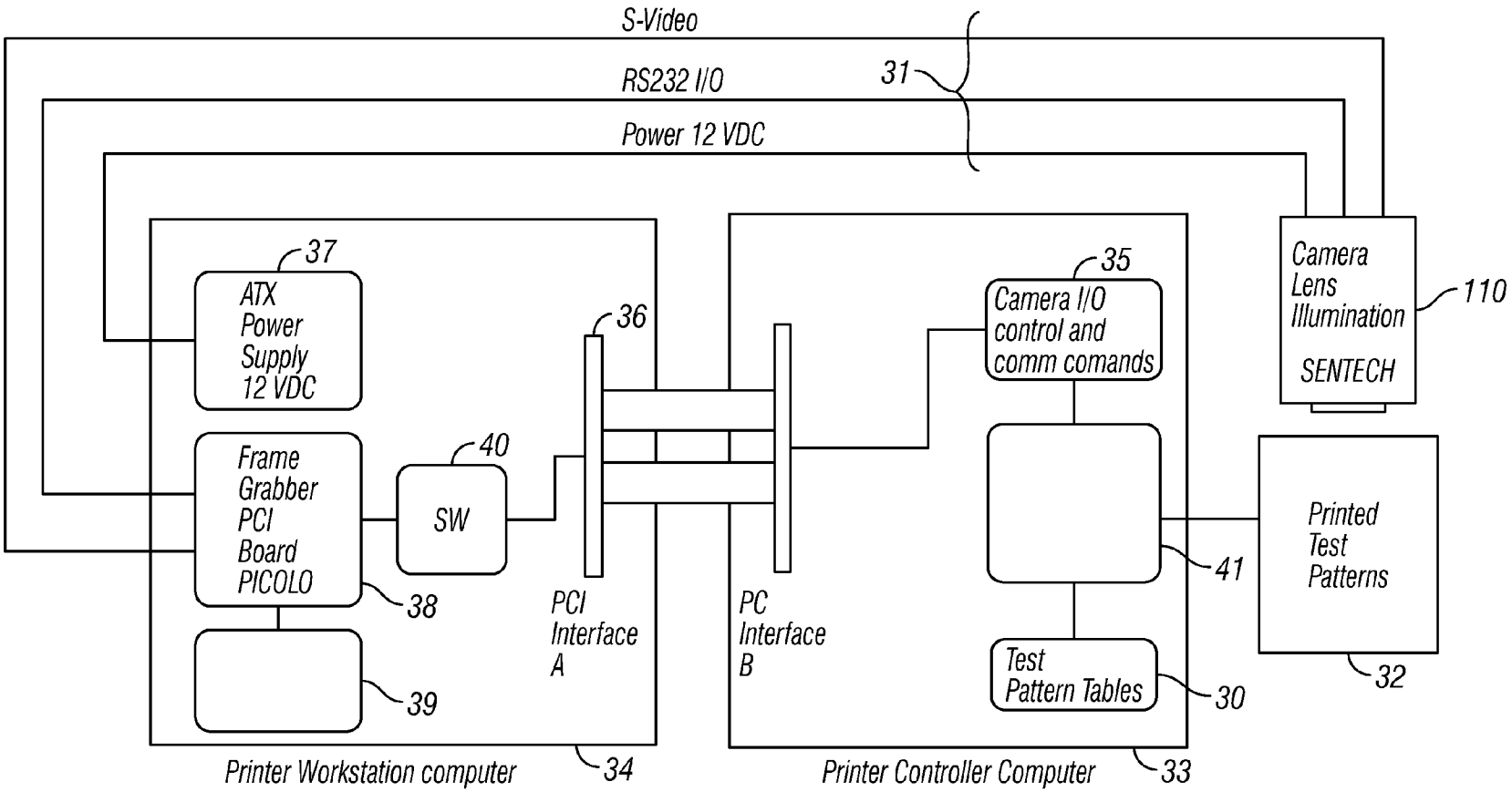
FIGS. 2*a* and 2*b* show block diagrams for a dot alignment vision system for an inkjet printer, including for use with printers without an Ethernet port (FIG. 2*a*) and for use with printers having an Ethernet port (FIG. 2*b*), according to the invention.
Figure 2B:
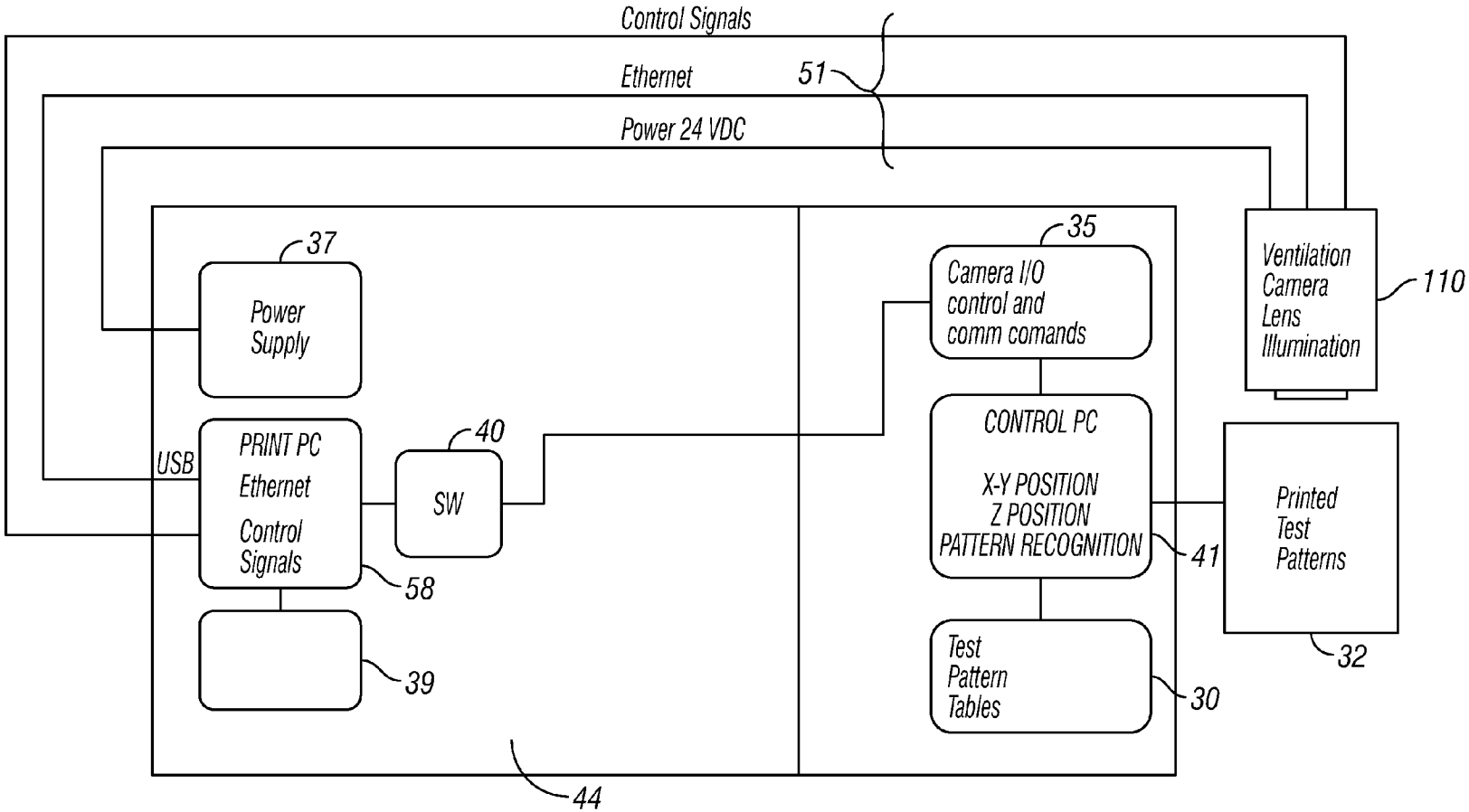

FIGS. 2*a* and 2*b* show block diagrams for a dot alignment vision system for an inkjet printer, including for use with printers without an Ethernet port, e.g. retrofit embodiments (FIG. 2*a*) and for use with printers having an Ethernet port, e.g. embedded embodiments (FIG. 2*b*), according to the invention. In FIGS. 2*a* and 2*b*, the camera assembly 110 is used to capture an image of one or more printed test patterns 32 and receives power from a power supply 37; the camera assembly communicates with system software 40 (discussed below) via a frame grabber and control module 38 (FIG. 2*a*) or a print PC, Ethernet control module 58 (FIG. 2*b*). The camera communicates with a printer workstation computer 34 via an interconnect 31 which, in turn, communicates via a PCI interface 36 with a printer controller computer 33 (FIG. 2*a*); or with a printer control system 44 via an interconnect 51 which includes an Ethernet connection.

In both embodiments, the test patterns are generated using test pattern tables 30 that are accessed by a control module 41. The control module generates the patterns, for example, for X-Y position, Z position, and pattern recognition tests, as discussed below. The control module 41 receives commands from system software 40 (discussed below) via a command I/O control and control command module 35. System user control and overall operation is effected by an application 39.

The camera enclosure is either retrofitted to, or embedded in, the printer. For common ink jet printers, the camera is preferably oriented so the available resolution is roughly 2000×2500 X,Y; and the target field of view is preferably 0.8" at approx 3300DPI. These values may be adjusted for different printers and different embodiments, but are all within the scope of the invention. Typically, the camera can be moved to any location X (Carriage), Y (Media). In some embodiments a servo or other mechanism is provided to effect camera movement.

Software Overview

Control Software

The control software consists of the necessary routines to coordinate testing and integrate the camera into the printer. These routines are designed to operate in accordance with the interface requirements for each of the camera and the printer. Such interface requirements themselves would be known to those skilled in the art.

Camera Functions

A library, e.g. a .dll or .so, contains a basic function set built from the Baumer BGAPI code. Other functions may be used with other cameras. For the embodiment that uses a Baumer camera, the following is noted:

pstat CamInit( )
Initialize the camera
pstat CamCapture(filename)
Captures an image and saves it to a file
BYTE * CamCapture( )

Captures an image and returns a pointer to the image in memory pstat CamDone( )

Shutdown the camera

Analysis Class

This class analyses the image and returns analysis results:

iBMP * img

Pointer to an image in memory double basic_pattern_line_spacing

This is the ideal distance between lines of the basic pattern. In a presently preferred embodiment, it should be 1/90=0.01111 . . . "

pstat read_basic_pattern(double * distance)

Measures the basic pattern and returns the distance from centers to outside lines:

| | |
|---|---|
| distance | pointer for result |
| returns | pass/fail status |

pstat measure_lines (int columns, int yexpect, int * yfound, Point * c, double * angle)

Measures centers of lines in rows and columns across the image, ignoring whitespace:

| | |
|---|---|
| columns | Number of columns (locations) to read |
| yexpect | Number of lines expected in each column |
| yfound | Pointer to array[columns] of column line counts |
| c | Pointer to array[columns, yfound[x]] of Points |
| angle | Average angle of pattern |
| returns | Pass/fail status |

pstat rotate90( )

Rotates the image in memory by 90°

Printer

The printer functions are fairly extensive with the ability to control and perform routines. Preferably these routines are scriptable.

pstat Shutter(bool open)

Generic function to open the shutter.

Analysis

Basic Pattern

Figure 3:
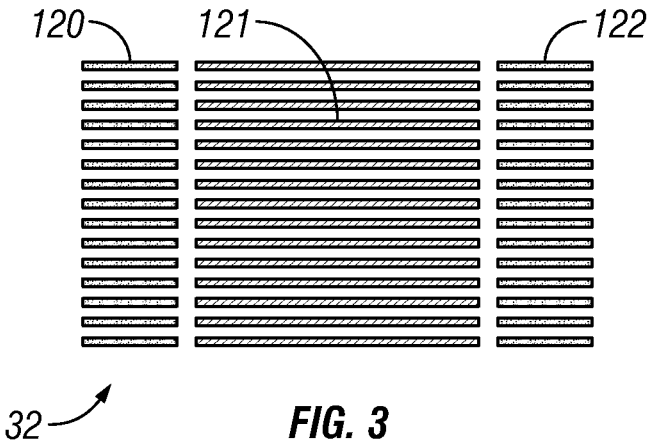
FIG. 3 is a schematic representation of a basic print pattern according to the invention.
Figure 4:
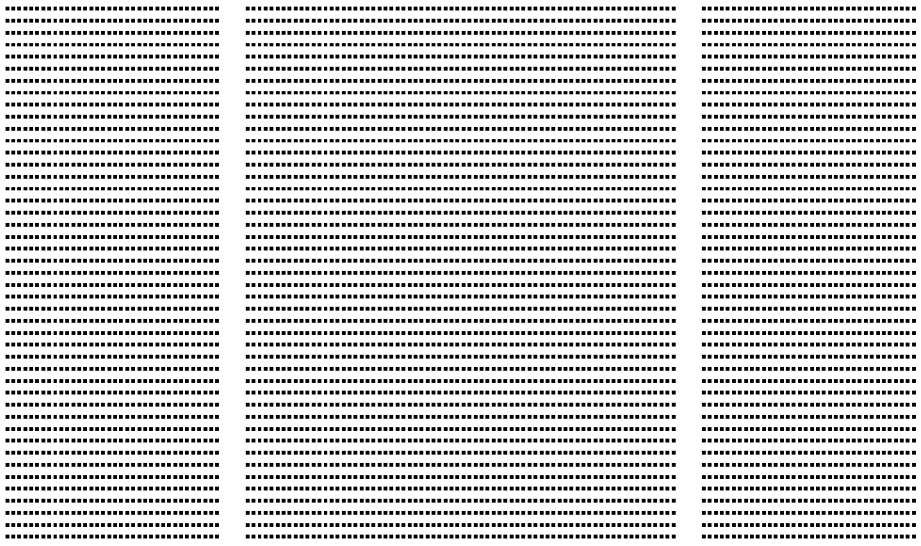
FIG. 4 is a detailed schematic representation of a basic print pattern according to the invention.

FIG. 3 is a schematic representation of a basic print pattern 32 according to the invention; and FIG. 4 is a detailed schematic representation of a basic print pattern according to the invention. One easily analyzed pattern provides the basis for this image analysis system in a presently preferred embodiment. The analysis class code functions return the offset distance, positive or negative, from the center section 120 to the outside sections 121, 122 (FIG. 3). In a presently preferred embodiment, the width of the pattern should be about ½" square to fit within the camera's field of view at maximum zoom and still leave room for positioning errors. The lines do not need to be coherent, e.g. they can be made of closely space dots (see FIG. 4). For ease of analysis, the spacing between the center and outside sections should be large enough to be distinguished from dot spacing.

The image angle is determined by measuring the Y offset between the left and right outside lines. Image Resolution is determined by measuring the average number of pixels between lines in the Y direction and then dividing by actual distance, which is known from the image. Accuracy is determined by measuring the top and bottom of the lines and then calculating a center of gravity. In this way, it is possible to achieve subpixel accuracies for each line. Multiple, e.g. about 45, lines are averaged to increase measurement reliability.

The basic pattern is analyzed as follows:

Missing lines are detected and compensated for in calculations.

Finding the centroid of each line provides subpixel (image) accuracy. By averaging all the lines, nozzle-to-nozzle deviations are minimized.

The two outside lines (black) should be printed by the same nozzle. They can used to determine the camera angle.

The spacing between the lines (pitch) is known and is used to determine the imaging resolution. For example, if the printed pitch is 180 DPI (1/180"=0.00555") and they average 20 pixels, then the imaging resolution is 3600 DPI. The camera pixels are square. The height of the lines should be less than ½ the spacing of the lines to aid in missing nozzle detection.

By calculating the distance that the center section is from the outside to outside line and dividing by the imaging resolution, one calculates the offset distance (outside to center distance) in inches.

Carriage Gap Repeatability

This test measures the repeatability of the carriage gap:

Gap Carriage;

Print the basic pattern vertically using a single print head:

outside lines left to right center lines right to left

Capture, rotate, and measure the offset distance;

Repeat from the gap carriage step;

Calculate min-max of distances. This is the carriage gap bidirectional error.

Step Repeatability

This test measures the repeatability of the step:

Print the basic pattern using a single print head:

outside lines on one pass step center lines on return pass

Capture and measure the offset distance;

Repeat from printing the basic pattern;

Calculate min-max of distances. This is the step error.

Carriage Alignment

Figure 5:
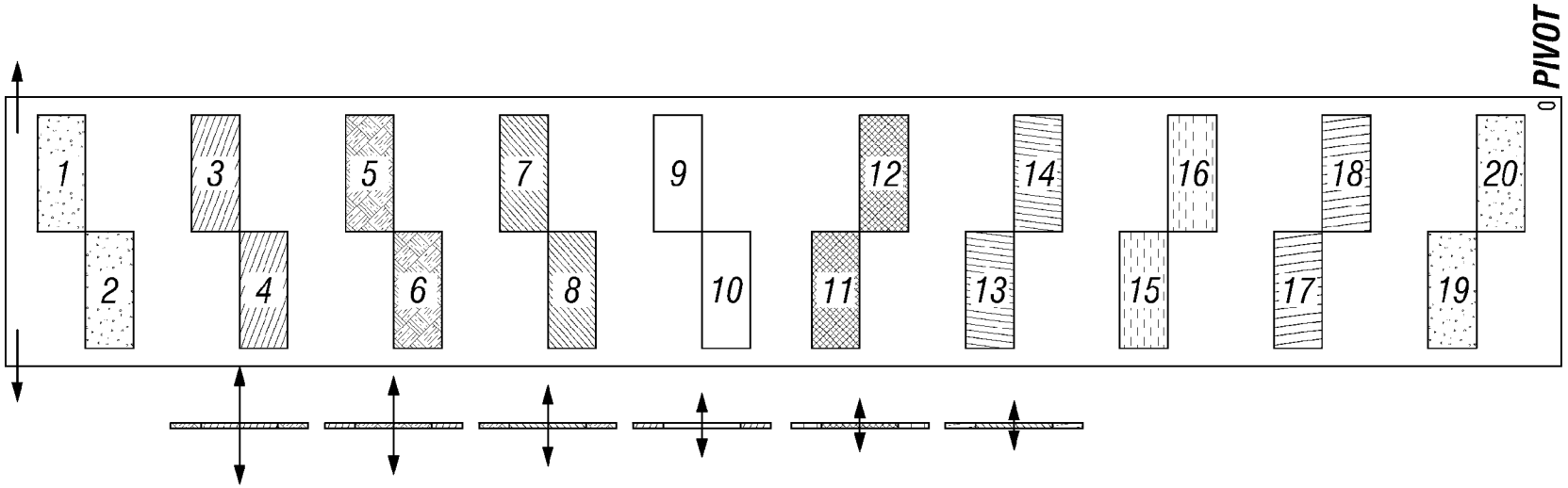
FIG. 5 is an image we print during alignments.

This test measures the parallelism of the jet plate to the beam. Drop Placement Suite for example:

Print several basic patterns as in FIG. 5, which is an image that has sets of patterns, similar to the Basic Pattern of FIGS. 3 and 4. The patterns are printed using jets that are farthest apart, to closest together:

Light cyan (16) and light yellow (3)

Yellow (18) and cyan (5)

Light cyan (16) and light magenta (7)

Yellow (18) and black (9)

Light cyan (16) and light black (11)

Yellow (18) and magenta (14).

By measuring these patterns and determining if they get progressively worse (and which direction) it is possible to determine if the carriage plate is skewed (rotated) overall;

Capture and measure outside and center (Y) positions;

Slope of outside vs. slope of center lines is the slope of carriage alignment.

Step Size

This test measures the step error:

Print basic pattern horizontally using a single print head:

a outside lines on one pass step center lines on return pass

Capture and measure outside to center (Y) distance. This is the step error;

Decrement step size by the step error.

Head Voltage

This test calibrates the head voltage:

Gap carriage to known value 0.060"

Set bidirectional to known value 0.058"

Print basic pattern vertically using a single head column:

outside lines left to right center lines right to left

Capture, rotate, and measure outside to center (Y) distance;

Adjust voltage, approx ½V per 0.00333";

Repeat from gap carriage step until within tolerance 0.0005."

Jetpack Placement X

This test measures the mechanical error in the X axis:

Print basic pattern vertically with outside lines printed by head 9, center lines printed by head in question. Print with the top portion of head. Print left to right.

Print same basic pattern right to left;

Print same basic pattern with bottom of head, left to right;

Print same basic pattern right to left;

Capture, rotate, and measure outside to center (Y) distance of all four above printed basic patterns;

Subtract right to left distances from left to right distance (velocity error). This is the head placement error, top and bottom;

Compare top and bottom errors, slope is slope of head.

Jetpack Placement Y

This test measures the mechanical error in the Y axis:

Print basic pattern with outside lines printed by reference head, center lines printed by head in question;

Capture and measure outside to center (Y) distance. This is the head placement error;

User adjusts setscrew 0.1"/turn to correct error.

Platen/Table Flatness

This test measures the overall pixel deviation due to table/rail parallelism:

Print the basic pattern vertically along the width of the media:

a outside lines left to right center lines right to left

Capture, rotate, and measure outside to center (Y) distance of all patterns;

Calculate min-max of distances. This is the table flatness bidirectional error.

Missing Nozzles

Figure 6:
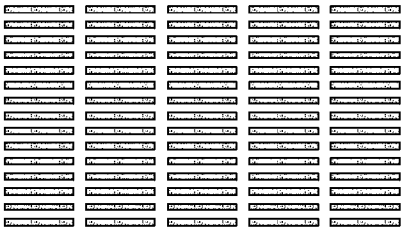
FIG. 6 is a schematic representation of a missing nozzle test pattern according to the invention.

FIG. 6 is a schematic representation of a missing nozzle test pattern according to the invention. This test finds missing nozzles. A modified basic pattern image is used as the jet test.

This test comprises five columns of lines, each line being one nozzle of one column of each head:

Print the jet test with the head/column in question;

Capture the image and count the lines in each column. This is the number of nozzles firing;

Use X,Y data for each line to calculate which nozzles are missing;

Update smoothing mask to reflect missing nozzles.

Other Embodiments

The following other embodiments are among those that may be implemented with the invention:

Media Edge Tracking—Edge and top of media are found.

Print head X Print Delay—Delay printing from print head by encoder to correct for jetpack X placement.

Carriage Velocity—60 frames per sec at 60 ips=720 dpi.

Vision System Software Overview

Basic System

A basic system prints an image and can have the image analyzed outside the system.

Enhanced System

An enhanced system has the hardware installed into the machine physically, as in an upgrade, but does not have the integrated features to take full advantage of automation.

1. Print required image file. This is designed to print the basic pattern using specific nozzles.
2. The operator moves the printer carriage with the camera and advance the media so that the image is in the viewing position.
3. A self-contained software package connected to the camera takes image. This image is measured by the software package and the resulting distance value is reported.
4. Operator takes distance value and implements. The operator adjusts printer parameters as recommended or physically adjusts hardware.
5. Process is repeated from Step 1 to verify that changes have taken effect and results are within tolerance.

Embedded System

The embedded system has the hardware installed into the machine physically and has the integrated features to take full advantage of automation.

1. The operator selects the appropriate test routine.
2. The printer prints the corresponding image file. This is designed to print the basic pattern using specific nozzles.
3. The printer automatically moves the camera and media so that the printout is visible in the camera.
4. Printer software uses the camera to take an image. This image is measured by the printer software module, and the resulting distance value is measured.
5. Adjustments made or recommended: Printer configurations that can be changed solely in software are adjusted automatically. If the results are outside of the printer's ability to adjust, such as a mechanical hardware adjustment, the printer reports to the operator that an adjustment is required.
6. Verification test is completed: If an automatic adjustment has been made the printer can automatically retest the output and re-measure to see if the results are within tolerance. Certain tests may require several iterations for fine tuning.
7. Testing Complete: Once the test has completed the printer can report back success or failure. If a test is successful the printer may continue on to another test that can be done sequentially, such as aligning subsequent print heads.

Machine Implementation

Figure 7:
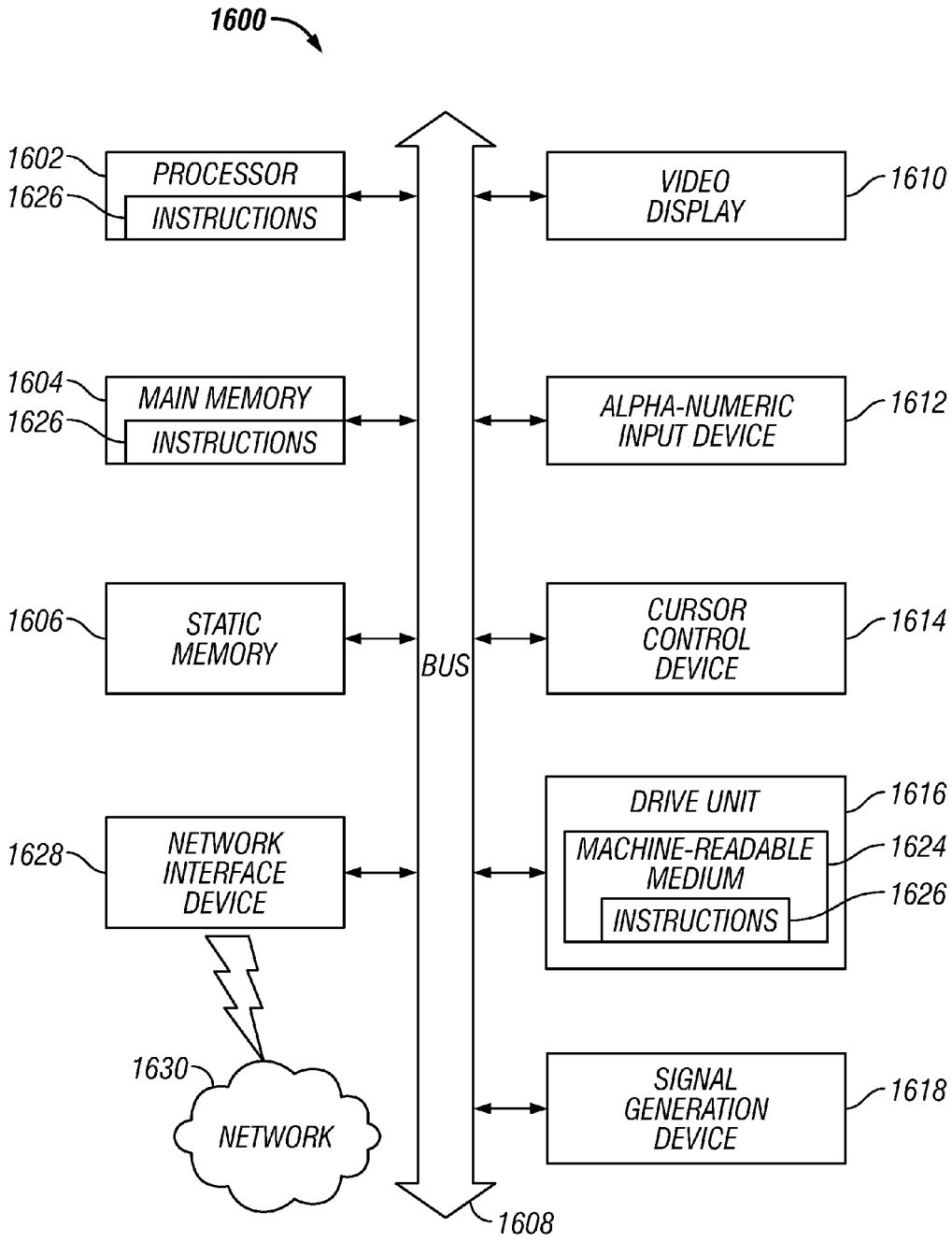
FIG. 7 is a block schematic diagram of a machine in the exemplary form of a computer system within which a set of instructions for causing the machine to perform any of the embodiments herein disclosed.

FIG. 7 is a block schematic diagram of a machine in the exemplary form of a computer system 1600 within which a set of instructions for causing the machine to perform any one of the foregoing methodologies may be executed. In alternative embodiments, the machine may comprise or include a network router, a network switch, a network bridge, personal digital assistant (PDA), a cellular telephone, a Web appliance or any machine capable of executing or transmitting a sequence of instructions that specify actions to be taken.

The computer system 1600 includes a processor 1602, a main memory 1604 and a static memory 1606, which communicate with each other via a bus 1608. The computer system 1600 may further include a display unit 1610, for example, a liquid crystal display (LCD) or a cathode ray tube (CRT). The computer system 1600 also includes an alphanumeric input device 1612, for example, a keyboard; a cursor control device 1614, for example, a mouse; a disk drive unit 1616, a signal generation device 1618, for example, a speaker, and a network interface device 1628.

The disk drive unit 1616 includes a machine-readable medium 1624 on which is stored a set of executable instructions, i.e., software, 1626 embodying any one, or all, of the methodologies described herein below. The software 1626 is also shown to reside, completely or at least partially, within the main memory 1604 and/or within the processor 1602. The software 1626 may further be transmitted or received over a network 1630 by means of a network interface device 1628.

In contrast to the system 1600 discussed above, a different embodiment uses logic circuitry instead of computer-executed instructions to implement processing entities. Depending upon the particular requirements of the application in the areas of speed, expense, tooling costs, and the like, this logic may be implemented by constructing an application-specific integrated circuit (ASIC) having thousands of tiny integrated transistors. Such an ASIC may be implemented with complementary metal oxide semiconductor (CMOS), transistor-transistor logic (TTL), very large systems integration (VLSI), or another suitable construction. Other alternatives include a digital signal processing chip (DSP), discrete circuitry (such as resistors, capacitors, diodes, inductors, and transistors), field programmable gate array (FPGA), programmable logic array (PLA), programmable logic device (PLD), and the like.

It is to be understood that embodiments may be used as or to support software programs or software modules executed upon some form of processing core (such as the CPU of a computer) or otherwise implemented or realized upon or within a machine or computer readable medium. A machine-readable medium includes any mechanism for storing or transmitting information in a form readable by a machine, e.g., a computer. For example, a machine readable medium includes read-only memory (ROM); random access memory (RAM); magnetic disk storage media; optical storage media; flash memory devices; electrical, optical, acoustical or other form of propagated signals, for example, carrier waves, infrared signals, digital signals, etc.; or any other type of media suitable for storing or transmitting information.

Although the invention is described herein with reference to the preferred embodiment, one skilled in the art will readily appreciate that other applications may be substituted for those set forth herein without departing from the spirit and scope of the present invention. For example, multiple alignment functions can be performed automatically and in a sequence until optimal printer alignment is achieved. Accordingly, the invention should only be limited by the Claims included below.

The invention claimed is:

1. A method for alignment of a printer having an array of inkjet heads, comprising the steps of:
- providing an enclosure to house a vision system and pattern recognition module;
- providing a shutter attached to said enclosure operable to protect said vision system;
- retrofitting said enclosure to said printer;
- using said vision system in connection with said printer to align said printer by:
  - generating at least one printed pattern of arrays of dots with said printer inkjet heads;
  - capturing printed pattern information produced by said printer inkjet heads with said vision system;
  - analyzing said printed pattern information captured by said vision system with said pattern recognition module and generating control signals for performing any of multiple alignment functions on said printer with said pattern recognition module;
  - automatically adjusting said printer inkjet heads based at least in part on said control signals; and
  - operating said shutter when said vision system is not in use to protect said vision system.

2. The method of claim 1, said alignment functions comprising any of:
- dot size, shape, and integrity;
- unidirectional, bidirectional, and step alignments;
- physical position and straightness of jet packs;
- flatness of platen or media belt;
- mapping imperfections in rods and rails of guiding systems;
- checking jet alignments from a reference jet to all other jet packs; and
- compensation for missing dots from disabled nozzles in one or more inkjet heads.

3. The method of claim 1, said control signals comprising:
- correction values that are generated to effect manual or automatic adjustment of any of said inkjet heads' physical position, voltage, temperature, and firing pulse timing and/or duration, and to accordingly position printed dots fired from said printer inkjet heads nozzles.

4. An electronic storage medium having stored therein program instructions which, when executed by a processor, implement the method of claim 1.

5. The method of claim 1, said alignment functions comprising any of:
- dot size, shape, and integrity;
- unidirectional, bidirectional, and step alignments;
- physical position and straightness of jet packs;
- flatness of platen or media belt;
- mapping imperfections in rods and rails of guiding systems;
- checking jet alignments from a reference jet to all other jet packs; and
- compensation for missing dots from disabled nozzles in one or more inkjet heads.

6. The method of claim 1, said control signals comprising:
- correction values that are generated to effect manual or automatic adjustment of any of said inkjet heads' physical position, voltage, temperature, and firing pulse timing and/or duration, and to accordingly position printed dots fired from said printer inkjet heads nozzles.

7. An electronic storage medium having stored therein program instructions which, when executed by a processor, implement the method of claim 1.

8. A method comprising the steps of:
- providing an enclosure to house a vision system and pattern recognition module;
- providing a shutter attached to said enclosure operable to protect said vision system;
- retrofitting said enclosure to said printer;
- configuring said vision system to align said printer by:
  - in response to generating at least one printed pattern of arrays of dots with said printer inkjet heads,
    - capturing printed pattern information produced by said printer inkjet heads with said vision system,
    - analyzing said printed pattern information captured by said vision system with said pattern recognition module, and
    - generating control signals for adjusting said printer inkjet heads; and
- operating said shutter when said vision system is not in use to protect said vision system.

* * * * *